US005931176A

United States Patent [19]

Isler et al.

[11] Patent Number: 5,931,176

[45] Date of Patent: Aug. 3, 1999

[54] HINGED TONNEAU COVER TRUCK TENT

[75] Inventors: Mark Isler, Warren; Don Minton, Lordstown; Connie Ball; Kevin Batchelder, both of Warren; Wayne Reinhart, Youngstown; Larry Saxon, Warren, all of Ohio

[73] Assignee: Sport Masters, Newton Falls, Ohio

[21] Appl. No.: 08/958,064

[22] Filed: Oct. 27, 1997

[51] Int. Cl.[6] ..... E04H 15/06

[52] U.S. Cl. ..... 135/88.15; 135/88.13; 135/88.16; 296/159; 296/160; 296/163

[58] Field of Search ..... 135/88.01, 88.13, 135/88.14, 88.15, 88.16, 88.03, 88.07, 88.09, 96, 115, 117, 119; 296/159–160, 163–165, 167

[56] References Cited

U.S. PATENT DOCUMENTS 3,411,819 11/1968 Tyree et al. .
3,746,386 7/1973 Woodward .
4,566,729 1/1986 Magnino .
5,213,390 5/1993 Borchers .
5,322,336 6/1994 Isler .
5,335,960 8/1994 Benignu, Jr. .
5,511,843 4/1996 Isler et al. .
5,526,866 6/1996 Flentge ..... 160/380
5,558,392 9/1996 Young .
5,758,679 6/1998 Tamburelli ..... 135/88.09

*Primary Examiner*—Beth Aubrey
*Attorney, Agent, or Firm*—Harpman & Harpman

[57] ABSTRACT

A hinged tonneau cover truck tent assembly to be used on truck beds to provide an extended enclosure on the truck bed. The hinged tonneau cover assembly has an internal perimeter frame that is removably secured to the front portion of the truck bed and has a detachable hinge assembly. The camping tent removably attached to the tonneau cover and extends over the existing tailgate of the truck bed. The hinged tonneau cover assembly can be raised at the tailgate end for immediate access to the truck bed defined within the enclosure of the tent.

12 Claims, 8 Drawing Sheets

*Fig. 9*
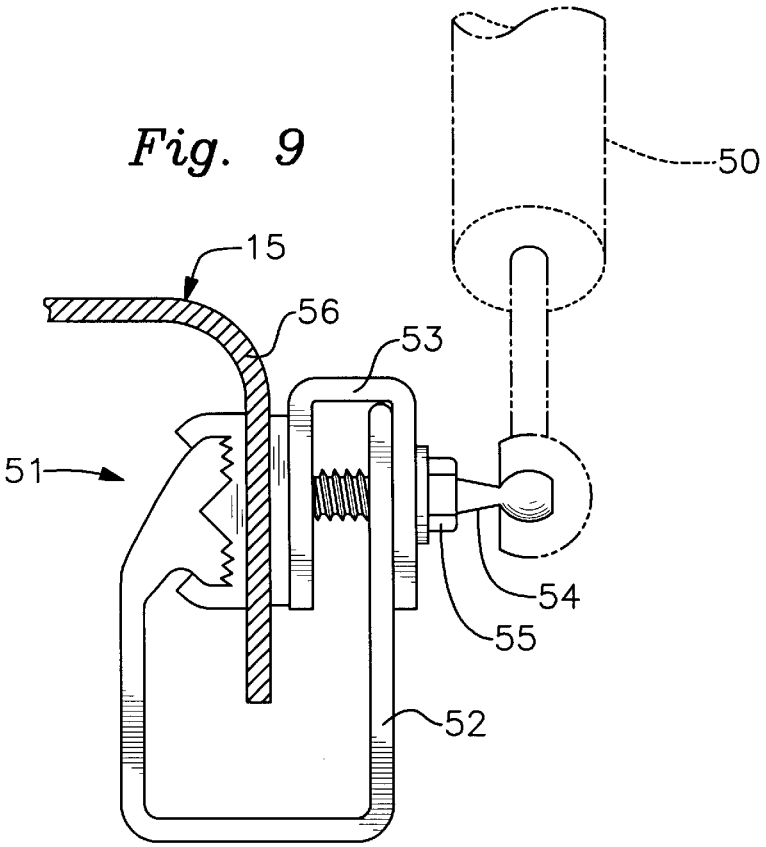
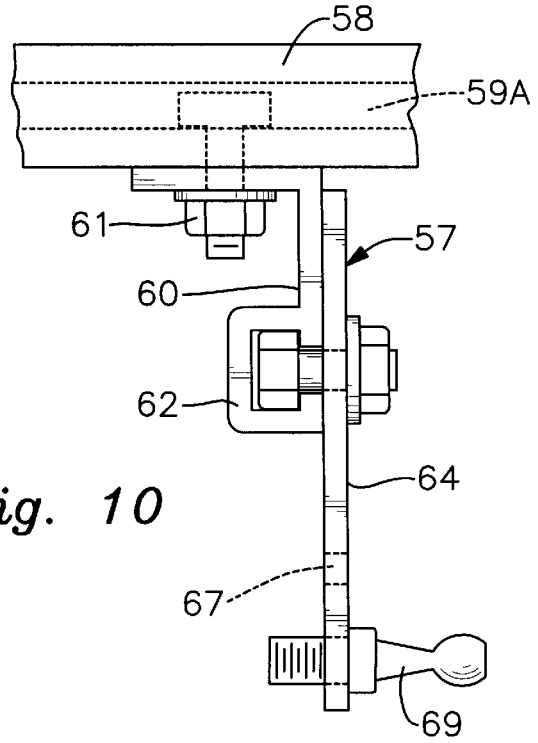
*Fig. 10*

HINGED TONNEAU COVER TRUCK TENT

BACKGROUND OF THE INVENTION

1. Technical Field

This device relates to camping tent assemblies that are secured over the truck bed of a pick-up truck to provide an enclosure removably secured to a tonneau cover and the truck bed.

2. Description of Prior Art

Prior art devices of this type have relied on a variety of erectable covers in which a flexible tents and covers extends from the truck bed, see for example U.S. Pat. Nos. 3,411,819, 3,746,389, 4,566,729, 5,213,390, 5,335,960, 5,558,392, 5,322,336 and 5,511,843.

U.S. Pat. No. 3,411,819 discloses an expandable camper having a rigid support body member and a detachable top with a flexible canvas insert therebetween.

U.S. Pat. No. 3,746,386 is directed to a tent for a rear doored vehicle having flexible enclosure that extends over and above the door and encloses the opening. The enclosure is secured to the vehicle by straps.

U.S. Pat. No. 4,566,729 claims a quick erection tent for pick-up trucks having a base frame mountable on the top of the truck bed side and front walls that extends to form a cloth enclosure.

U.S. Pat. No. 5,213,390 is directed to a vehicle mounted shelter that has a rigid plastic shell extending over the truck bed that is pivoted upwardly. The shell walls extend from the shell with an extensible portion over the tailgate of the truck bed.

U.S. Pat. No. 5,335,960 shows a tonneau/tent shelter which has a pivoted frame from the tailgate portion of the truck bed with a contoured cloth covering extending thereover to form a shelter.

U.S. Pat. No. 5,558,392 illustrates a combination boat/camper shell pop-up tent wherein a camper shell for a pick-up truck bed is formed from an inverted boat hull. An extensible frame extends and holds the shell in spaced pivoted relation to the truck bed.

U.S. Pat. No. 5,322,336 is directed to a hinged tonneau cover for a pick-up truck bed having a tonneau cover frame pivotally secured to a truck bed that allows for easy access thereto by raising the cover and frame assembly on a hinged piston and cylinder device.

U.S. Pat. No. 5,511,843 discloses a slant rail tonneau cover having a perimeter frame with cross support ribs in tension and a flexible cover secured thereover by a plurality of longitudinally spaced fasteners on the perimeter frame.

SUMMARY OF THE INVENTION

A hinged tonneau cover trunk tent assembly for pick-up truck beds and the like wherein a portion of the tonneau cover and frame hinges from a remaining portion on the bed to form an enclosure mounting surface. A tent configuration having flexible walls and access opening is removably secured to the perimeter edge of the raised tonneau cover portion enclosing the truck bed and extended tailgate of the truck. A flexible closure flap seals the access opening and a detachable canopy extends from the tent with independent support poles.

DESCRIPTION OF THE DRAWINGS

FIG. 9 is an enlarged end plan view of a pivot clamp mount for a cylinder and piston assembly on the truck bed;

FIG. 10 is an enlarged side elevational view of an adjustable mounting bracket latch support and pivot mount for the cylinder and piston assembly on the tonneau frame assembly;

DESCRIPTION OF THE PREFERRED EMBODIMENT

Figure 1:
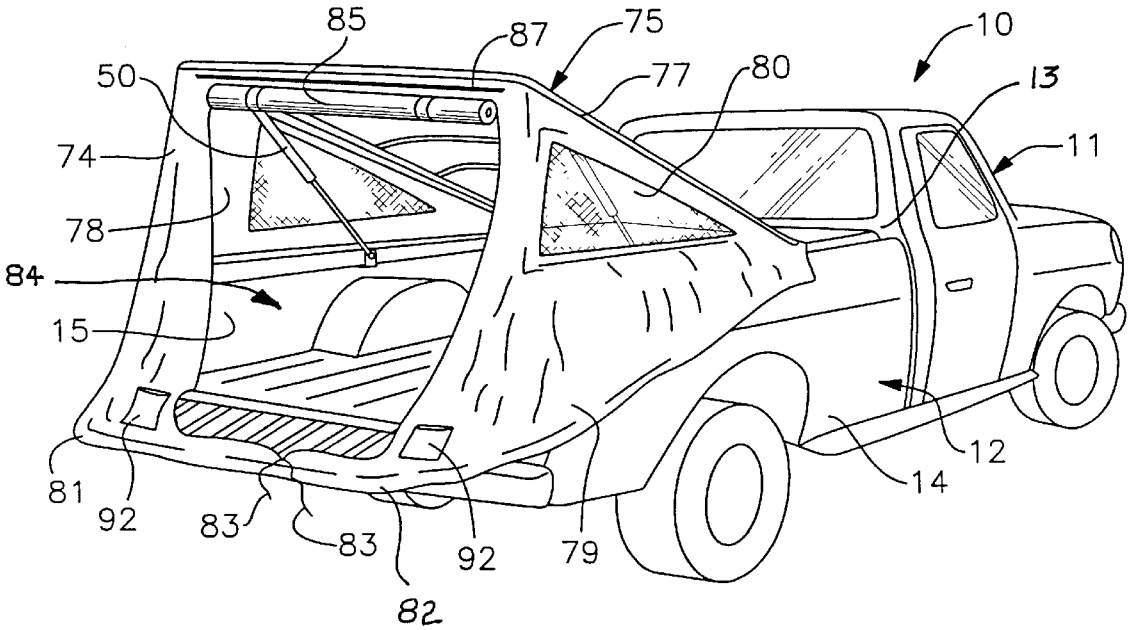
FIGS. 1 & 15 are each a perspective view of a pick-up truck with hinged tonneau cover truck tent assembly thereon in extended open position.
Figure 2:
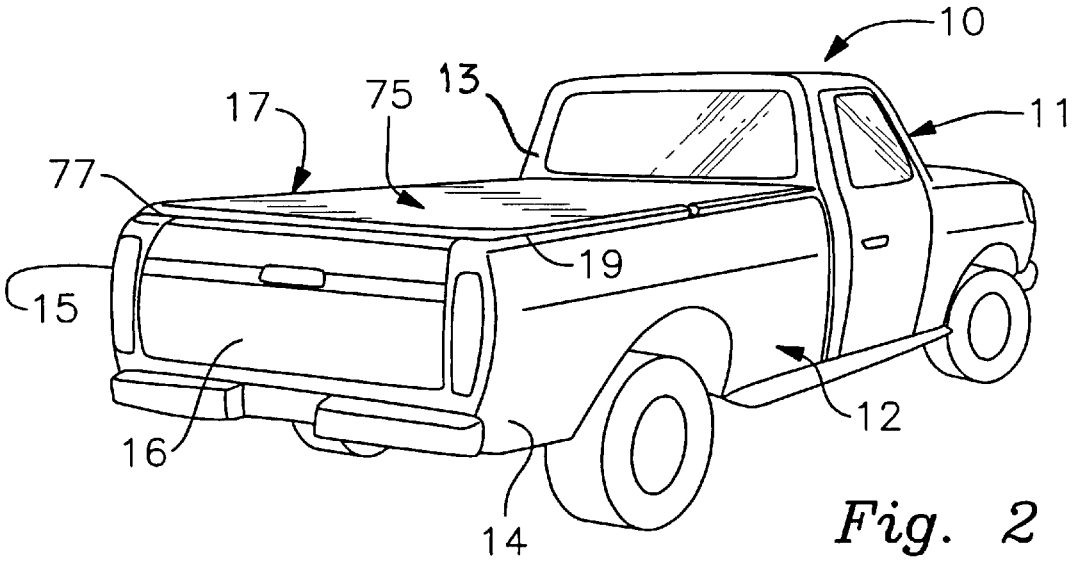
FIG. 2 is a perspective view of the pick-up truck with the hinged tonneau cover truck tent assembly in closed position.
Figure 5:
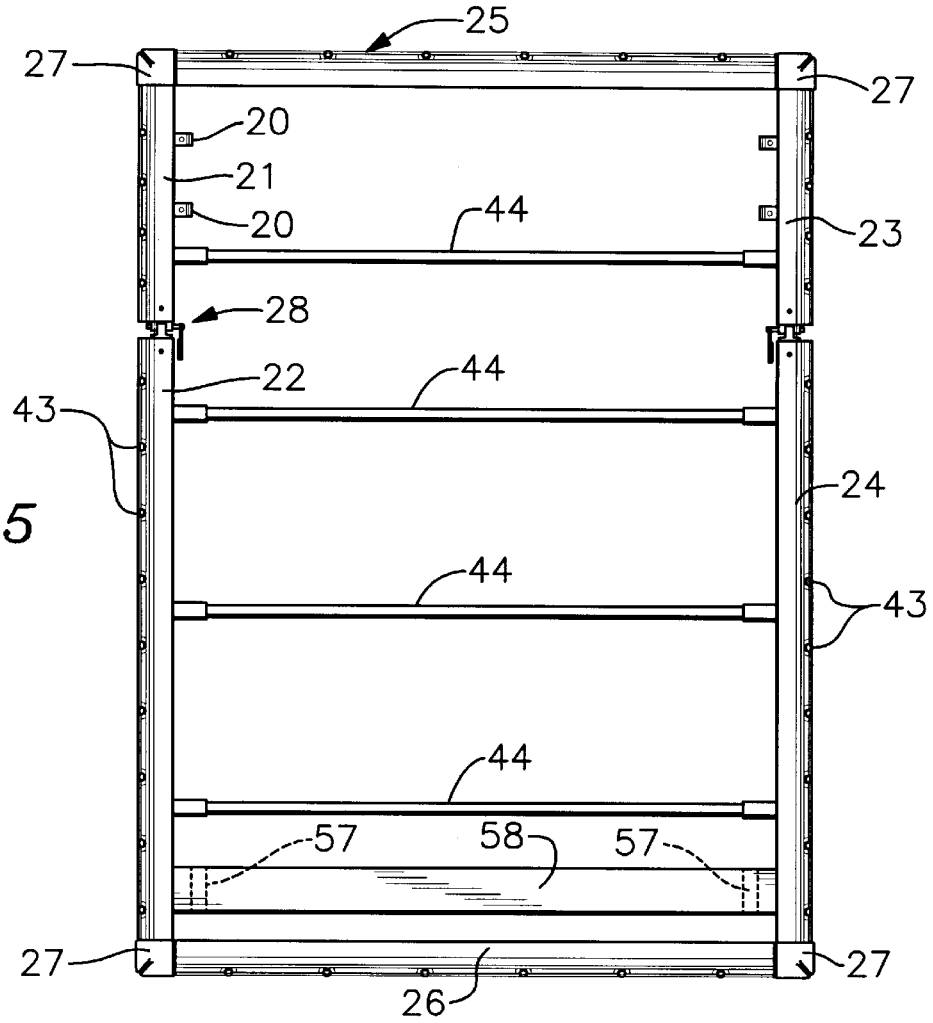
FIG. 5 is a top plan view of the tonneau cover frame assembly of the invention.

Referring to FIGS. 1, 2 and 5 of the drawings, a pick-up truck 10 can be seen having a cab portion 11, and a bed portion 12. The bed portion 12 has a front wall 13, oppositely disposed sidewalls 14 and 15 and a movable tailgate 16. A hinged tonneau cover truck tent assembly 17 can be seen, having a main support frame 18 removable positioned around the perimeter top edge surface 19 of the front, sidewalls and tailgate 13, 14, 15, and 16 respectively by a plurality of removable C clips 20.

The main support frame 18 is comprised of side rail pairs 21 & 22 and 23 & 24 and oppositely disposed end rails 25 & 26, the cross-section of the rails 21–24 are similar to that set forth in applicant's earlier U.S. Pat. No. 5,511,843 cited as a reference herein.

Figure 6:
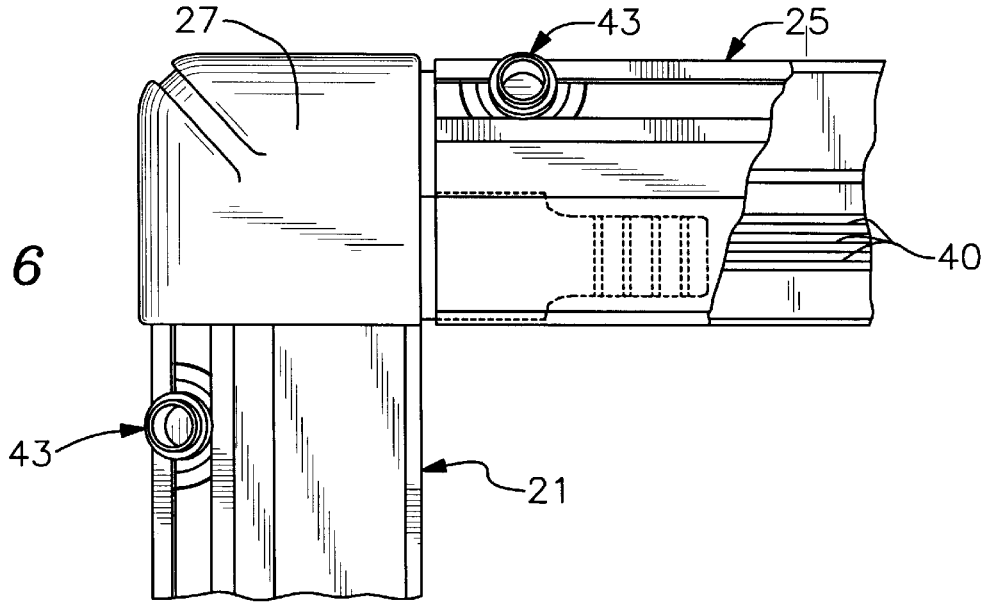
FIG. 6 is an enlarged top plan view of a corner connection portion of the tonneau frame.

The side rail pairs are interconnected to the respective end rails by molded corner connectors 27 as seen in FIGS. 5 and 6 of the drawings.

Multiple pairs of the C clamps 20 engage the respective side rails 21 and 23 securing the main support frame 18 to the sidewalls 14 and 15 of the pick-up truck bed portion 12.

Figure 3:
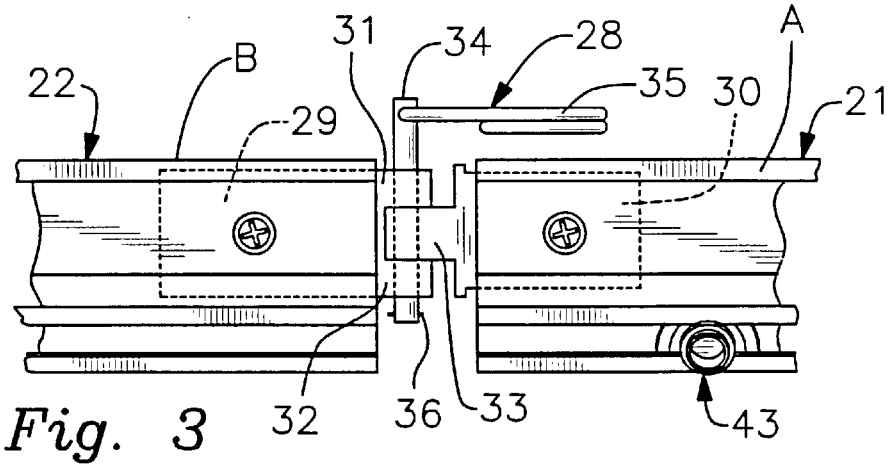
FIG. 3 is an enlarged top plan view of the hinge assembly of the tonneau cover.
Figure 4:
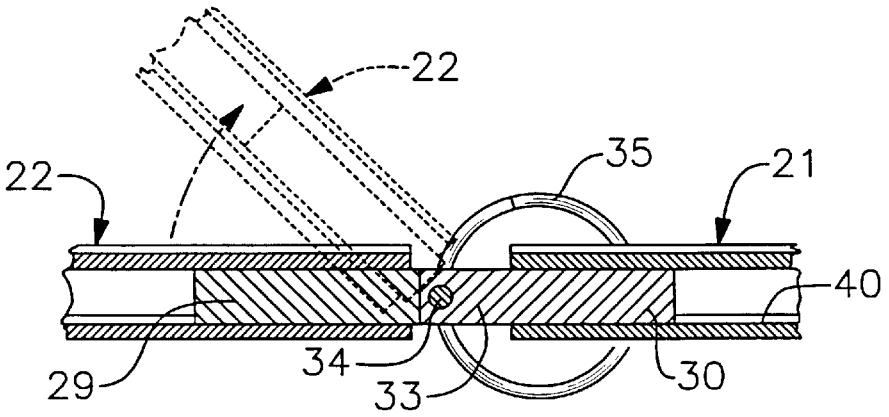
FIG. 4 is a side elevational view of the hinge assembly illustrated in FIG. 3 of the drawings with portions in broken lines illustrating the hinge position.
Figure 7:
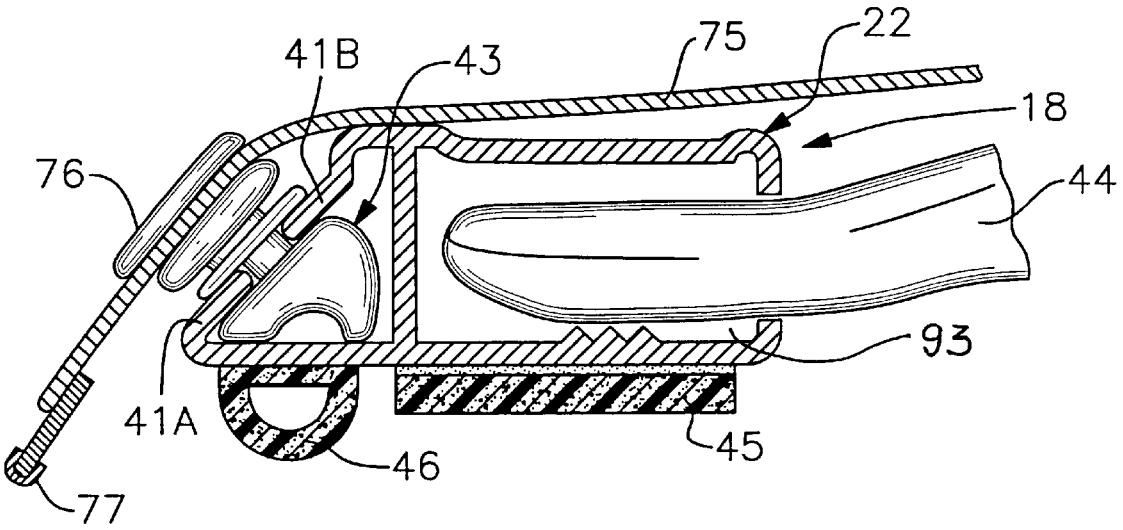
FIG. 7 is an enlarged cross-sectional view with portions broken away of a side rail of the support frame assembly of the invention.

Each of the side rails 21–24 are identical in cross-section as seen in FIG. 7 of the drawings with said respective side rail pairs 21 & 22, 23 & 24 are interconnected to one another in end to end relationship by respective hinge assemblies 28, best seen in FIGS. 3 and 4 of the drawings.

Each of the hinge assemblies 28 have a pair of interengaging hinge blocks 29 and 30 that are inserted into the respective effacing open ends of the side rail pairs 21 & 22, and 23 & 24. The hinge block 29 has a pair of spaced aligned aperture lugs 31 and 32 for registerable engagement with an apertured lug 33 on the opposing block 30. A pivot and release pin 34 extends through the respective apertured lugs, with a pull ring 35 at one end and a retaining pin button 36 in oppositely disposed relation thereto, as will be well understood by those skilled in the art.

Figure 8:
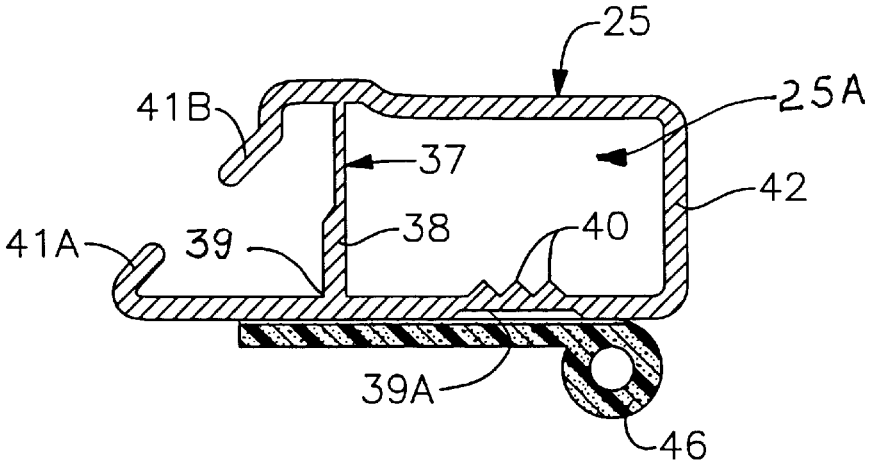
FIG. 8 is an enlarged cross-sectional view of an end rail of the support frame.
Figure 11:
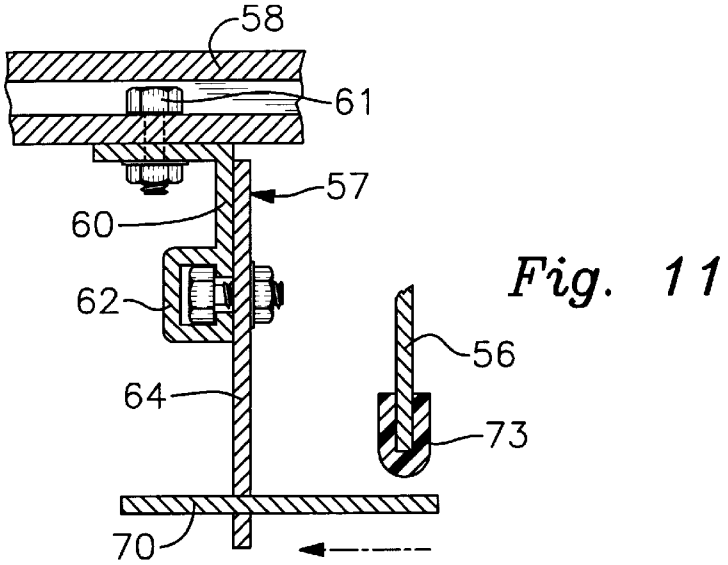
FIG. 11 is a enlarged partial cross-sectional side elevational view of the mounting bracket, latch and pivot support shown in FIG. 10 with the latch rod extending therethrough.

The end rails 25 and 26, as seen in FIG. 8 of the drawings, are identical to one another in cross-section and have improved features over applicant's own prior art rail configurations hereinbefore described.

Specifically, the improvement is drawn to that of an upstanding center wall portion 37 having an area of increased transverse dimension at 38 with a base 39 with a recessed area 39A and a plurality of spaced parallel upstanding ribs 40.

Each of the respective side and end rails have slotted angular surfaces 41A and 41B with the slotted angular surfaces 41A and 41B having a plurality of longitudinally spaced snap fastener insert assemblies 43 within as best seen in FIG. 7 of the drawings. Opposing side surfaces 42 in the end rails 25 & 26 define an enclosed rail area 25A within.

The main support frame 18 has a plurality of cover support bows 44 which are inserted within and extend in tension between the opposing side rail pairs 21 & 22 and 23 & 24. All of the side rails and end rails have foam strips 45 and gaskets 46 adhesively secured to their underside of the respective base rail portions as is well understood by those skilled in the art.

Figure 13:
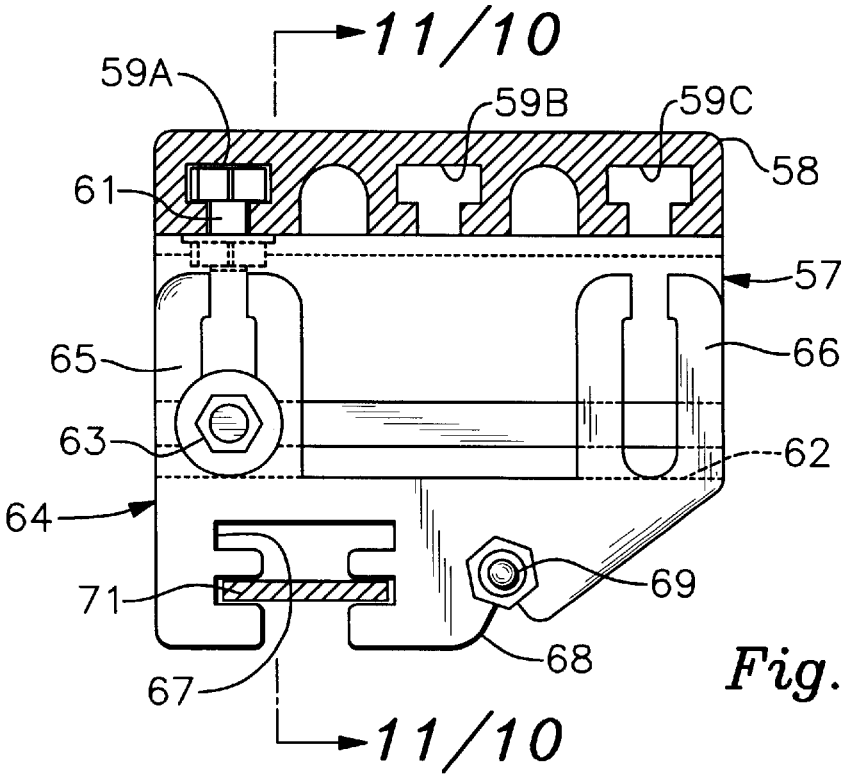
FIG. 13 is a front plan view of the adjustable mounting bracket latch support and pivot mount with latch rods illustrated in FIG. 12.

Referring to FIGS. 1, 9 and 10 of the drawings, a pair of frame support piston and cylinder assemblies 50 extend from the sidewalls 14 and 15 to the main support frame 18, supporting same in open position. The piston and cylinder assemblies are mounted on a cylinder clamp mount 51 illustrated in FIG. 9 of the drawings secured to the respective sidewalls 14 and 15. The cylinder clamp mounts 51 have a U-shaped body member 52 with an adjustable apertured insert 53 positioned thereon. The insert 53 overlies an apertured clamp portion having a cylinder engagement stud 54 and adjustable bolt 55 adjustably positioned therethrough. The cylinder clamp mount 51 engages a wall flange 56 of the respective sidewalls 14 and 15 of the truck bed portion 12. The piston and cylinder assemblies 50 are pivotally secured to the main support frame 18 by an adjustable latch and alignment bracket 57 that extends from a latch rail 58, best seen in FIGS. 1, 5 and 13 of the drawings. The latch rail 58 is formed of an aluminum extrusion having multiple elongated mounting slots; 59A, 59B and 59C formed therein. The latch rail 58 extends between and registers within the respective side rails 22 and 24 adjacent the rail end 26.

The latch and alignment bracket 57 has a generally L-shaped first element 60 secured by a pair of nut and bolt assemblies 61 extending from the mounting slots 59A, and 59C through apertures in a first element 60. A bolt engagement slot 62 in the first element 60 extends transversely thereacross with mounting bolts 63 extending therefrom for registering with a secondary element 64, best seen in FIG. 13 of the drawings. The second element 64 has a pair of upstanding open-ended slotted flanges 65 and 66 and a multiple contoured notch 67 and mounting stud receiving notch 68 having cylinder engagement stud fitting 69 extending therefrom.

Referring now to FIGS. 11–14 of the drawings, a pair of elongated rigid lock elements 70 and 71 are pivotally secured to an activation handle 72 that extends from the center portion of the latch rail 58, and attachment slot 59B. Free ends of the locking elements 70 and 71 extend through the multiple contoured notches 67 of the respective oppositely disposed support element brackets 57.

Figure 14:
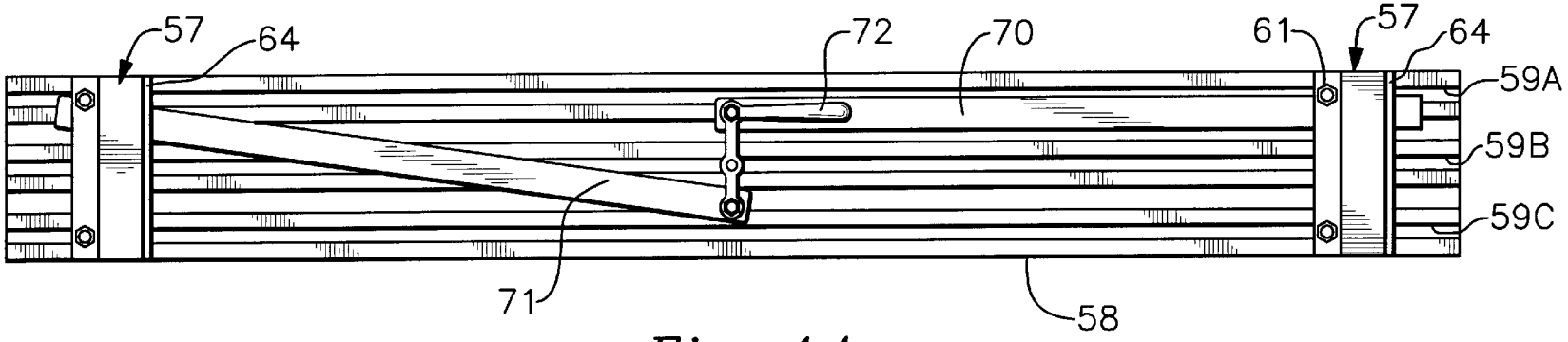
FIG. 14 is a side elevational view of the pick-up truck with the hinged tonneau cover truck tent assembly of the invention with an attached canopy.
Figure 12:
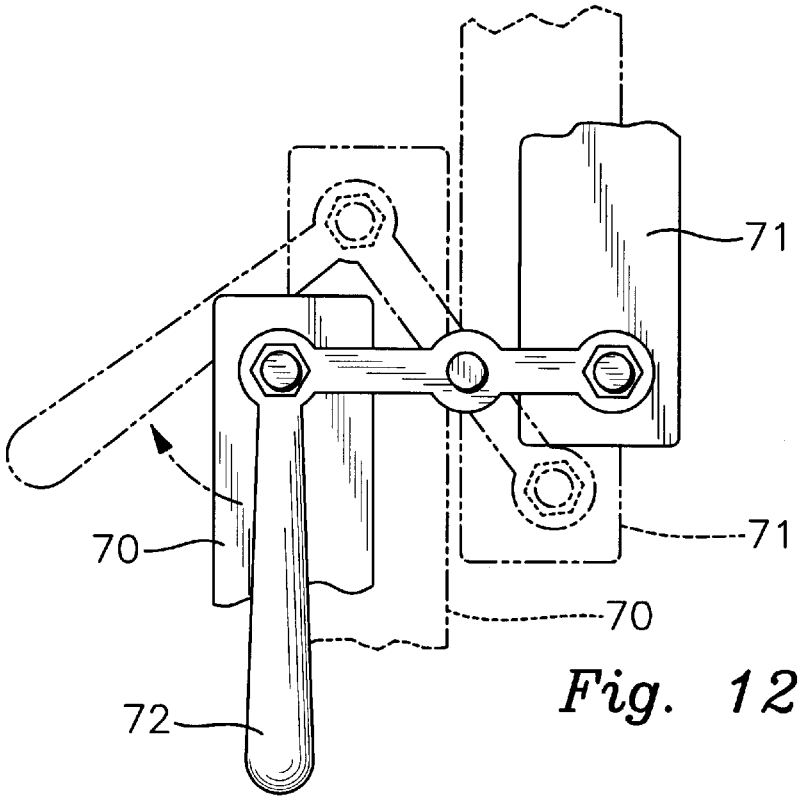
FIG. 12 is a top plan view of the latch assembly handle engagement portion.

It will be evident from the above description that upon rotation of the handle 72 the attached pivoted lock elements 70 and 71 will correspondingly extend as is illustrated in solid lines in FIGS. 12 and 14 of the drawings securing the attached main frame 18 to the truck sidewalls.

A resilient engagement fitting 73 is fitted over a portion of the respective sidewall flanges 56 so as to be in engaged alignment with the ends of the hereinbefore described lock elements 70 and 71 when extended.

To unlock the movable portion of the main frame 18 for deployment of the truck tent 17, the handle 72 is rotated as is illustrated in broken lines in FIG. 12 of the drawings, retracting the interconnected locking elements 70 and 71 releasing the main frame 18 so as to provide movement of same to an open position shown in FIG. 1 of the drawings. A truck tent enclosure 74 is formed of flexible canvas/cloth material that is removably attached to the perimeter edge of a flexible fabric tonneau cover 75 that is in turn secured to the main frame 18 by a plurality of the snap fasteners 43 generally illustrated in FIG. 2 of the drawings and in greater detail in FIG. 7 of the drawings.

The cover snap fastener 76 engage the snap fastener insert assembly 43 holding the tonneau cover 75 tightly thereon over the cover support bows 44 as will be well understood by those skilled in the art.

A zipper 77 is secured to the upper respective edges of the truck tent 17 and conversely to the tonneau cover 75 allowing for ease of attachment and removal thereof.

The truck tent 74 has contoured flexible sidewalls 78 and 79 with screened window inserts 80 within. The sidewalls 78 and 79 extend from the attachment points with the tonneau cover 75 aligning the respective side rails 22 and 24 down over the outside of the truck sidewalls 14 and 15 and around a portion of the adjacent truck tailgate 16 when the gate is in down position. Flexible gate engagement pockets 81 and 82 are formed on the bottom perimeter edge of the walls 78 and 79 so as to extend around and encompass the tailgate 16.

Draw cords 83 are sewn into channels within the truck gate pocket 81 and 82 so as to secure same by pulling about the truck tailgate 16. An access opening at 84 extends between the respective sidewalls 78, and 79 and between the tailgate and the raised main frame portion 18. A flexible flap 85 is deployable from the tent 74 to act as a closure for the access opening at 84 as hereinbefore described.

Figure 15:
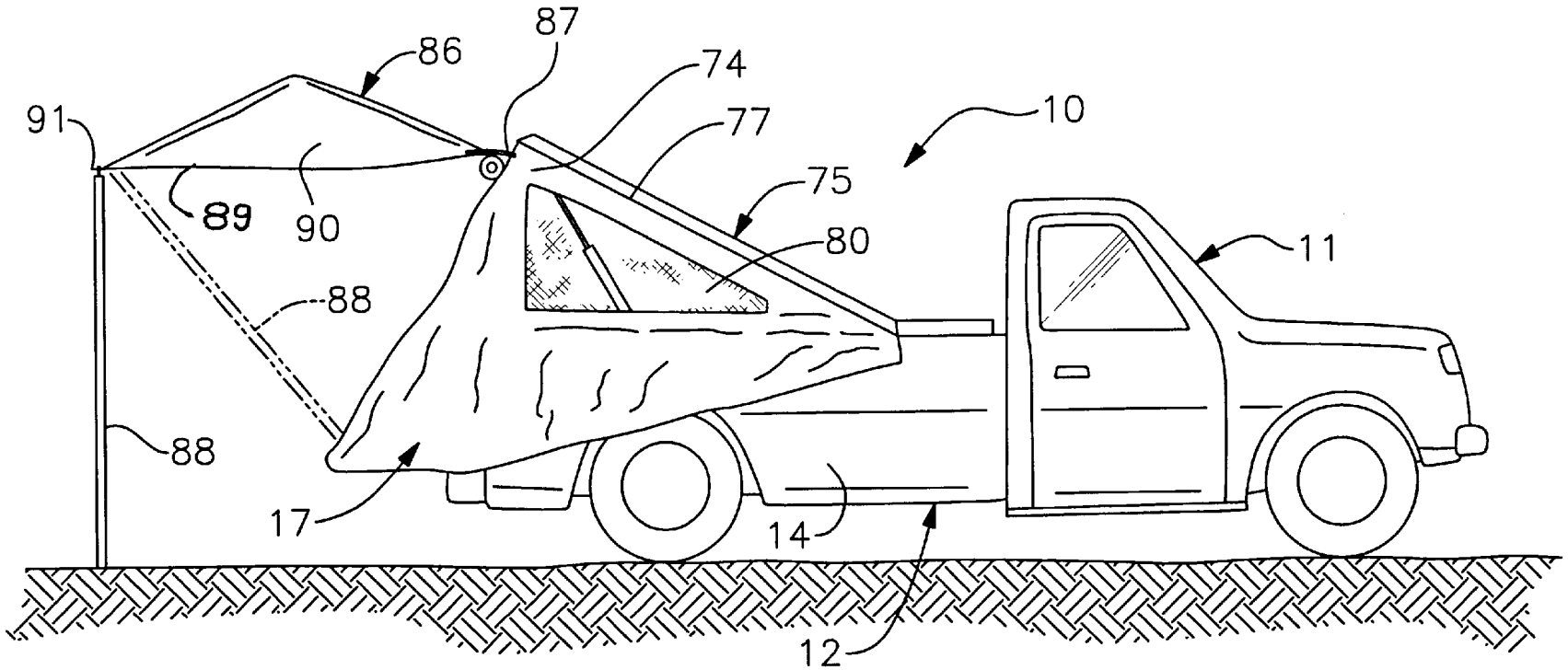

Referring now to FIG. 15 of the drawings, the fully erected truck tent assembly 17 of the invention is illustrated being fully deployed on the truck 10. An alternate canopy assembly 86 can be seen attached to the upper perimeter surface of the truck tent 74 by an oversize zipper 87 attached thereto. The canopy assembly 86 typically has a pair of support posts 88 extending from its opposing free end corners providing support for a frame 89 and cloth cover 90 as will be well understood by those skilled in the art. A second zipper 91 extends along the canopy's cover 90 perimeter edge at between the support posts 88 so that the canopy may be used independently of the truck tent 74 by rotation of same to engage a portion of the tonneau cover zipper 77 adjacent the end rail 26 as hereinbefore described. Alternately, the support posts 88 can be inserted into post receiving pockets 92 sewn into the truck tent. This allows the use of the canopy assembly 86 in a multiple fashion.

It will be evident from the above description that the support bows 44 are wedgeably positioned within respective elongated access openings 93 in the opposing side rails 21 & 23 and 22 & 24 as illustrated in FIG. 7 of the drawings. Further that the C clamps 20 are also engaged within access openings 93 of the opposing side rails 21 & 23 securing that portion of the main support frame 18 to the sidewalls 14 and 15.

It will be apparent to those skilled in the art that various changes and modifications may be made without departing from the spirit of the invention, therefore I claim:

1. A hinged tonneau cover truck tent assembly mountable on a bed portion of a pick-up truck, said bed portion including; opposing sidewalls, a front wall and a pivoting support tailgate, said assembly comprising; a main support frame including pairs of opposing side rails interconnecting end rails between said respective side rail pairs, each side rail comprised of a fixed portion and a hinged portion, means for hingeably connecting the hinged portion and the fixed portion of each of said side rail pairs in end to end relationship, support bows between said portions of said side rail pairs, a fabric cover extending over said support frame and said support bows, said cover comprising a plurality of flexible walls removably secured to the hinged portions of said main support frame, one of said flexible walls having an access opening to permit occupants to access therethrough, means for securing one of said flexible walls to said tailgate, extensible securing means interconnecting the hinged portions of said main support frame with said bed portion, means for securing the fixed portions of said main support frame to said bed portion adjacent said front wall, means for selectively spacing said hinged portions of said main support frame in angular spaced relation to said truck bed.

2. The hinged tonneau cover truck tent assembly set forth in claim 1 wherein said means for hingeably connecting said hinged portion and said fixed portion of each of said side rail pairs comprises; a hinge assembly having a pair of hinge blocks positioned within said side rail pairs, interengaging aligned apertured lugs extending from said respective hinge blocks, a pivot pin extending through said apertured lugs.

3. The hinged tonneau cover truck tent assembly set forth in claim 1 wherein said means for securing one of said flexible walls to said tailgate comprises; engagement pockets formed in said one of said walls overlying said tailgate, and means for securing said engagement pockets on and about a perimeter outside edge of said tailgate.

4. The hinged tonneau cover truck tent assembly set forth in claim 3 wherein said means for securing said engagement pockets onto and about said tailgate comprises; draw cords within said engagement pockets.

5. The hinged tonneau cover truck tent assembly set forth in claim 1 wherein said extensible securing means interconnecting the hinged portions of said main support frame with said truck bed portion comprises; a latch rail extending between said opposing side rail pairs, a plurality of latch support and alignment brackets extending from said latch rail, a pair of movable latch elements extending respectively through said latch support brackets, handle means interconnecting said movable latch elements and advancing the elements from a first position to a second position engageable with said opposing sidewalls.

6. The hinged tonneau cover truck tent assembly set forth in claim 1 wherein said means for selectively spacing said hinged portions of said support frame in angular spaced relation to said truck bed comprises; piston and cylinder assemblies pivotally secured to said main support frame and said bed portion of said pick-up truck.

7. The hinged tonneau cover truck tent assembly set forth in claim 1 wherein said means for securing the fixed portions of said main support frame to said bed portion adjacent said front wall comprises; multiple clamps engageable on said pairs of opposing side rails adjacent said front wall of said truck bed.

8. The hinged tonneau cover truck tent assembly set forth in claim 1 wherein said end rails have an upstanding center wall with an area of increased transverse dimension, an opposing sidewall surface and a base, defining an enclosed area therebetween.

9. The hinged tonneau cover truck tent assembly set forth in claim 8 wherein said base has a plurality of upstanding parallel elongated ridges and a recessed area within said base opposite said ridges.

10. The hinged tonneau cover truck tent assembly set forth in claim 1 further comprises; an auxiliary canopy assembly removably positioned to a portion of said flexible walls adjacent said access opening therein, support rods extending from oppositely disposed end corners of said auxiliary canopy assembly for engagement to the ground.

11. The hinted tonneau cover truck tent assembly set forth in claim 10 wherein said auxiliary canopy has a secondary fastening means positioned between said end corners which is selectively secured to said fabric cover extending over said support frame adjacent said access opening in said flexible walls.

12. The hinged tonneau cover truck tent assembly set forth in claim 10 wherein said support rods are registerable within pockets on said truck tent assembly for mobile use.

* * * * *